US005950888A

United States Patent [19]

Nolan-Brown

[11] Patent Number: 5,950,888

[45] Date of Patent: Sep. 14, 1999

[54] DETACHABLE ACTIVITY FLAP

[76] Inventor: Patricia Nolan-Brown, P.O. Box 3263, Wakefield, Mass. 01880-0755

[21] Appl. No.: 09/114,313

[22] Filed: Jul. 13, 1998

[51] Int. Cl.[6] ..... A42B 1/06

[52] U.S. Cl. ..... 224/172; 2/209.13; 446/27; 446/227

[58] Field of Search ..... 2/48, 49.1, 172, 2/209.13; 446/26, 27, 28, 227; D2/861, 862, 863, 864, 866, 891, 895

[56] References Cited

U.S. PATENT DOCUMENTS

| | | | |
|---|---|---|---|
| D. 341,019 | 11/1993 | Ostrow | D2/862 |
| 2,519,512 | 8/1950 | Stone | 2/172 |
| 3,184,883 | 5/1965 | McCook . | |
| 4,710,979 | 12/1987 | Bull et al. | 2/48 |
| 4,903,698 | 2/1990 | Huber et al. | 606/235 |
| 5,046,195 | 9/1991 | Koritan | 2/172 |
| 5,062,157 | 11/1991 | Muta | 2/171 |
| 5,081,717 | 1/1992 | Shedd et al. | 2/199 |
| 5,121,507 | 6/1992 | Brown | 2/199 |
| 5,153,943 | 10/1992 | Clement | 2/199 |
| 5,201,077 | 4/1993 | Dondlinger | 2/199 |
| 5,400,440 | 3/1995 | Clifford | 2/172 |
| 5,448,778 | 9/1995 | Phillips | 2/172 |
| 5,617,584 | 4/1997 | Brennan | 2/172 |

*Primary Examiner*—Diana L. Oleksa
*Attorney, Agent, or Firm*—John P. McGonagle

[57] ABSTRACT

A thematic activity neck flap which may be attached to a cap or about the neck of a backpack wearer. The flap is functional and comfortable for a wearer as well as providing a thematic ambiance. The flap has thematic items attached thereto such as pediatric items comprised of shapes, teethers and hanging toys. The flap may also have different textures consistent with a pediatric theme.

7 Claims, 5 Drawing Sheets

DETACHABLE ACTIVITY FLAP

BACKGROUND OF THE INVENTION

This invention relates to wearing apparel and, in particular, to an activity flap accessory.

Backpacking with babies has become a popular family activity. The baby is typically carried in a modified backpack apparatus wherein the baby is seated facing and lying against the back of the person carrying the child, or seated facing and lying against the chest of the person carrying. When the baby is placed in such a backpack they are in a position that only allows them to stare at the neck, head or chest of the backpack wearer. If the baby is able to, they will generally reach for and pull the wearer's hair or jewelry for entertainment. This becomes uncomfortable for the backpack wearer and such discomfort is usually communicated to the baby. This results in an unhappy baby and even more uncomfortable backpack wearer.

SUMMARY OF THE INVENTION

The present invention provides an activity neck flap which may be attached to a cap. The flap, whether attached to a cap or not, is functional and comfortable for the backpack wearer as well as providing a means of satisfying the baby's natural curiosity and alleviating the baby's boredom. The flap, when attached to a cap worn by the backpack wearer is in perfect position to stimulate the baby. The flap may have attached shapes, teethers and hanging toys. The shapes can contain rattles or crinkly paper for further stimulation. The flap may also have different textures for the baby to feel.

Baseball-type caps with a bill in the front and an adjustment band in the back have become extremely popular and are worn by diverse segments of the population for work and leisure. The neck flap may be permanently or removably attached to the cap. There may be several interchangeable flaps with varying themes, such as sports. The shapes, teethers and hanging toys may be permanently or removably attached to the flap.

The primary purpose, therefor, of the present invention is to provide a flap arrangement with or without a functional hat for a wearer, which provides visual and tactile stimulation, especially for a baby in an adjacent backpack.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
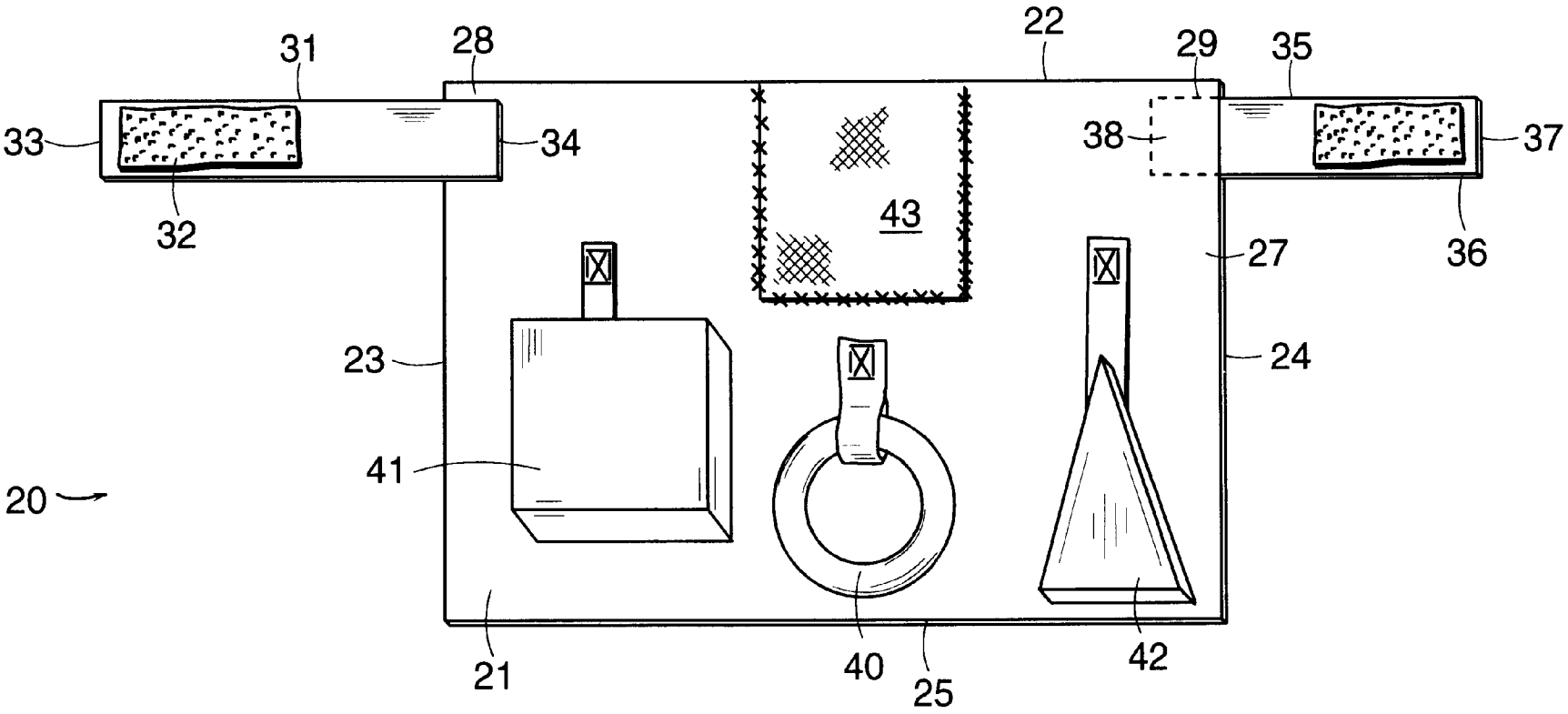
FIG. 1 is an outside, flat, plan view of the present invention.
Figure 3:
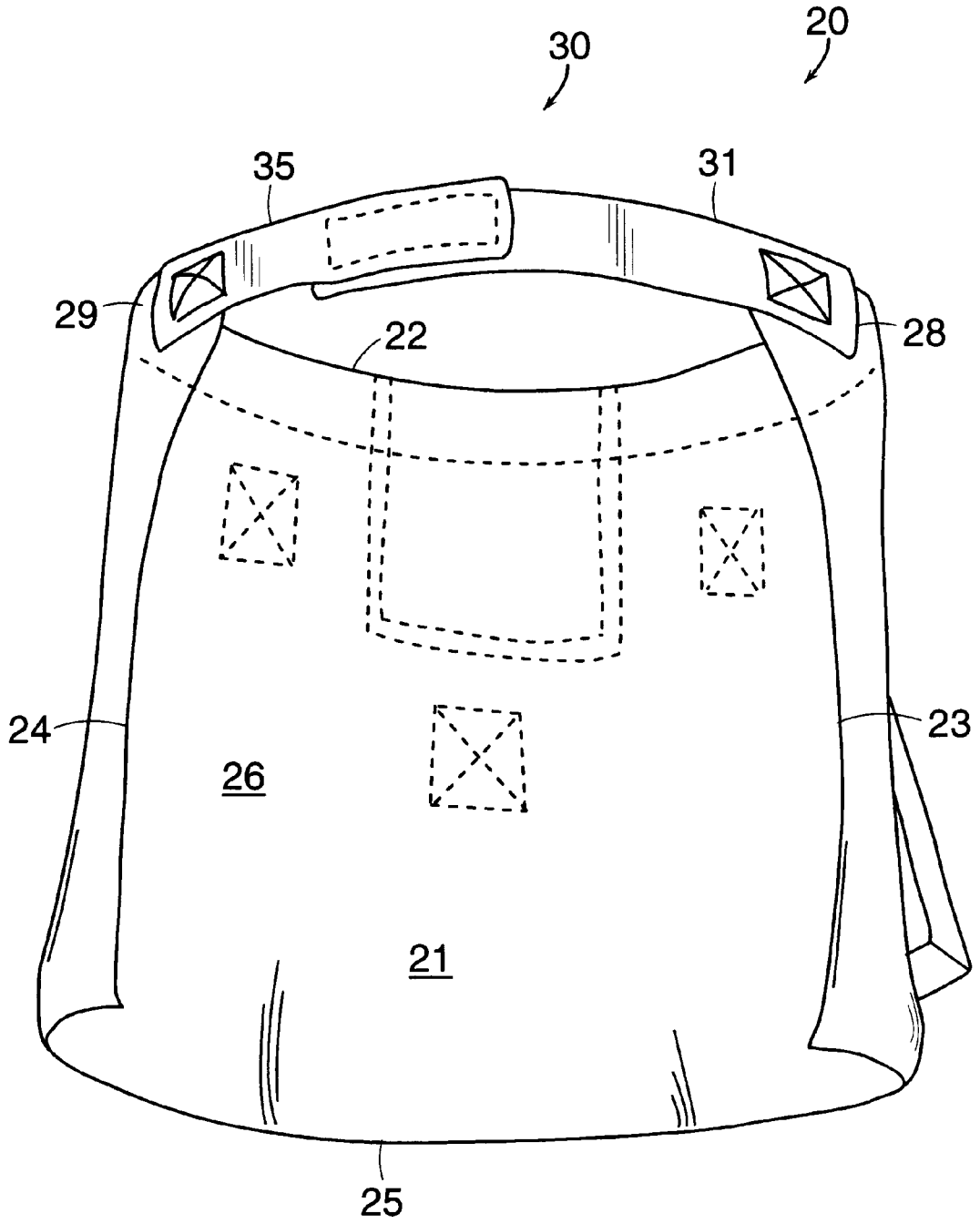
FIG. 3 is an inside view of the present invention with strap free ends joined.
Figure 4:
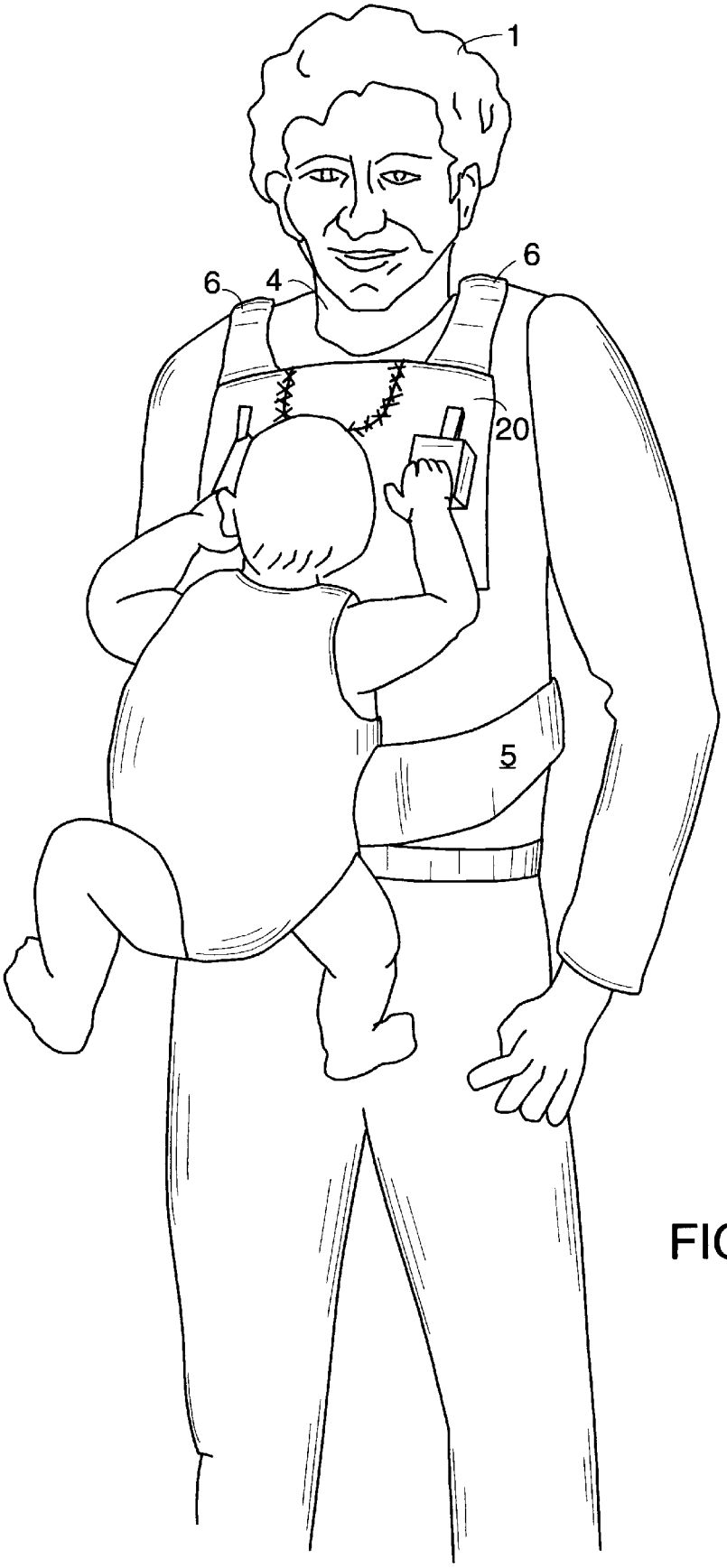
FIG. 4 is a perspective view of the present invention attached to a rear backpack.
Figure 5:
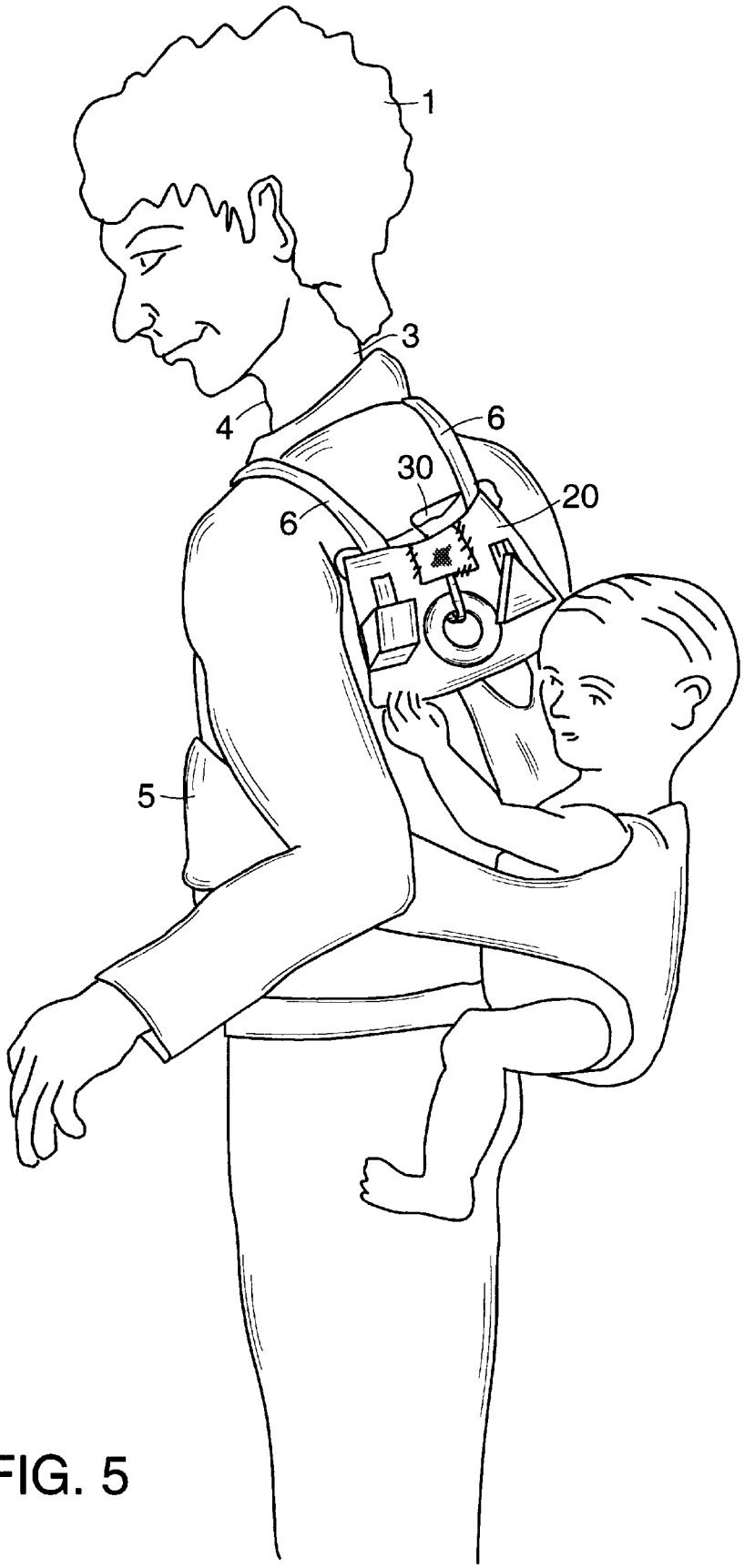
FIG. 5 is a perspective view of the present invention attached to a front backpack.

Referring to the drawings in detail, especially FIGS. 1 and 3, wherein like elements are indicated by like numerals, there is shown an activity flap 20 comprised of a flap portion 21 and a strap 30. The flap portion 20 has a top edge 22, a left side 23, a right side 24, a bottom edge 25, an inside surface 26 and an outside surface 27. The strap 30 is fixedly attached to the flap portion top edge 22. In this embodiment of the invention the strap 30 is comprised of a left portion 31 with a hook and pile type fastener strip of material 32 such as VELCRO attached thereto and a right portion 35 with a hook and pile type fastener strip of material 36 such as VELCRO attached thereto. VELCRO is a trademark for a hook and pile type fastener. Other types of fasteners such as snaps, buckles, pins and the like may also be used. The left strap portion 31 has a free end 33 and an opposite end 34 fixedly attached at a junction 28 formed by the flap top edge 22 and flap left side 23. The right strap portion 35 has a free end 37 and an opposite end 38 fixedly attached at a junction 29 formed by the flap top edge 22 and flap right side 24. The free ends 33, 37 generally have fasteners at or near to them. The activity flap 20 may be attached about the neck 2 of a wearer 1 or about one or more straps 6 of a carrier 5. See, especially, FIGS. 4 and 5. The strap free ends 33, 37 encircle the wearer's neck 2 (or carrier straps 6) and are joined together comfortably about the neck 2. The flap portion 21 is positioned to hang down from the neck rear 3 or neck front 4 of the wearer 1.

The activity flap outside surface 27 has a number of items providing activities attached thereto, some permanently attached and some removably attached with, for example, hook and pile fasteners. Examples of items attached to the flap 21 with a pediatric theme are a tethered teether 40, a tethered rattle 41, a brightly colored tethered shape 42, a patch 43 of textured material, tethered stuffed animal, alphanumerics, reflectors, a pacifier, and the like. Items consistent with other themes, such as for a sport, holiday, birthday, special occasion and the like, may also be attached to the flap 21.

Figure 2:
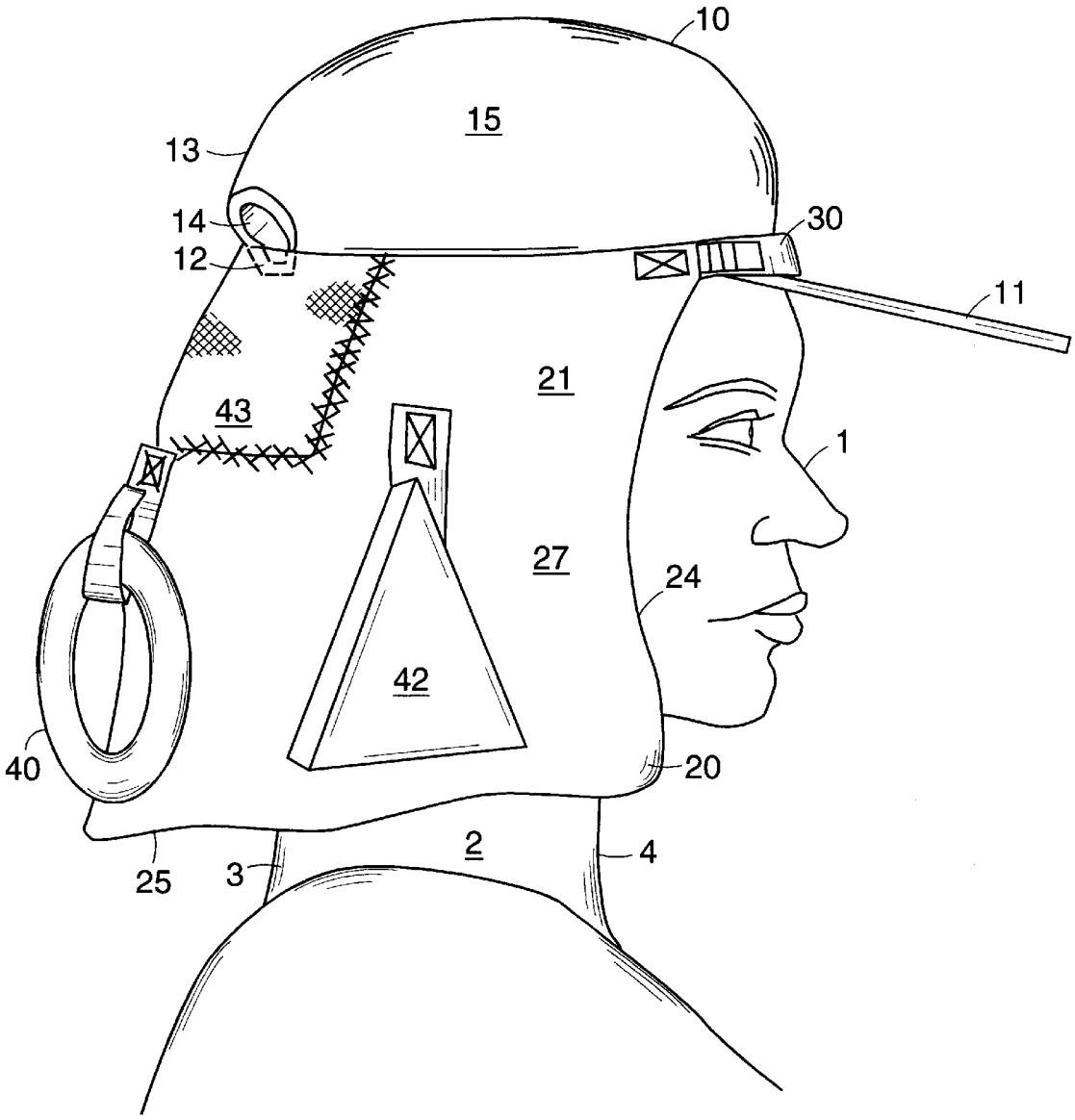
FIG. 2 is a side elevational view of the present invention attached to a cap.

As shown especially in FIG. 2, the activity flap 20 may be used in conjunction with a conventional baseball-style cap 10 having a crown 15, front bill 11 attached to the crown 15, and a separable and adjustable, or fixed, band 12 in the rear 13 of the crown 15. The cap 10 also includes an inverted U-shaped opening 14 in the cap crown rear 13 which is bridged by the band 12. Although a baseball cap is used for exposition purposes, any type of hat having a crown and some type of front bill or brim would be satisfactory. The activity flap 20 is positioned about the cap 10 so that the flap portion 21 is at the cap crown rear 13 with the flap portion inside surface 26 facing the neck 2 of a wearer 1. The strap free ends 33, 37 encircle the cap crown 15 and are joined together over the cap front bill 11. Alternatively, the activity flap could be permanently attached to a cap by means of the strap 30 and/or flap top edge 22.

It is understood that the above-described embodiment is merely illustrative of the application. Other embodiments may be readily devised by those skilled in the art which will embody the principles of the invention and fall within the spirit and scope thereof.

I claim:

1. An activity flap accessory in combination with a hat, for providing visual and tactile stimulation and adapted to be worn by a person, comprising:

a flap portion having a top edge, a left side, a right side, a bottom edge, an inside surface and an outside surface;

a strap fixedly attached to the flap portion top edge, wherein said strap is comprised of:

a left portion having a free end with a fastener and an opposite end fixedly attached at a junction formed by the flap top edge and flap left side;

a right portion having a free end with a fastener and an opposite end fixedly attached at a junction formed by the flap top edge and flap right side;

wherein the activity flap strap free ends are adapted to encircle a portion of a person's anatomy and are adapted to be joined together;

wherein said flap portion is adapted to hang down from said strap; and a plurality of thematic items attached to said flap portion outside surface, a number of which are permanently attached thereto and a number of which are removably attached thereto;

a hat having a crown and front brim portion;

wherein the activity flap strap free ends encircle the hat crown and are joined together over the hat front brim portion.

2. A hat in combination with an activity flap accessory for providing visual and tactile stimulation and adapted to be worn by a person, comprising:

a hat portion having a crown and a front brim portion;

a flap portion having a top edge, a left side, a right side, a bottom edge, an inside surface and an outside surface;

a strap fixedly attached to the flap portion top edge; and a plurality of thematic items attached to said flap portion outside surface, a number of which are permanently attached thereto and a number of which are removably attached thereto;

wherein said flap portion is positioned about said hat portion by said strap so that the flap portion inside surface is adapted to face a neck of a person.

3. The combination as described in claim 2, wherein said strap is comprised of:

a left portion having a free end with a fastener and an opposite end fixedly attached at a junction formed by the flap top edge and flap left side;

a right portion having a free end with a fastener and an opposite end fixedly attached at a junction formed by the flap top edge and flap right side;

wherein the activity flap strap free ends encircle the hat crown and are joined together over the hat front brim portion;

wherein said flap portion is adapted to hang down from said strap.

4. The combination as described in claim 3, wherein:

the activity flap is fixedly attached to said hat portion by said strap and flap top edge.

5. A hat in combination with an activity flap accessory for providing visual and tactile stimulation to a baby carried in a modified backpack apparatus worn by a person wherein the baby is seated in said backpack facing and lying against the back of a person carrying the baby, said flap accessory being adapted to being worn by the person at the back of the person's head in combination with said hat when said hat is worn by the person, comprising:

a hat portion having a crown and front brim portion;

a flap portion having a top edge, a left side, a right side, a bottom edge, an inside surface and an outside surface;

a strap fixedly attached to the flap portion top edge; and a plurality of thematic items attached to said flap portion outside surface, a number of which are permanently attached thereto and a number of which are removably attached thereto;

wherein said flap portion is positioned about the hat portion by said strap so that the flap portion inside surface is adapted to face a back neck of a person wearing said combination.

6. The combination as described in claim 5, wherein said strap is comprised of:

a left portion having a free end with a fastener and an opposite end fixedly attached at a junction formed by the flap top edge and flap left side;

a right portion having a free end with a fastener and an opposite end fixedly attached at a junction formed by the flap top edge and flap right side;

wherein the activity flap strap free ends encircle the hat crown and are joined together over the hat front brim portion;

wherein said flap portion is adapted to hang down from said strap at the back neck of a person wearing the combination.

7. The combination as described in claim 6, wherein:

the activity flap is fixedly attached to said hat portion by said strap and flap top edge.

* * * * *